US006142881A

United States Patent [19]

Lakusiewicz

[11] Patent Number: 6,142,881

[45] **Date of Patent: *Nov. 7, 2000**

[54] ANATOMICALLY CONFIGURED FINGER INSERTS FOR A BOWLING BALL

[76] Inventor: Ronald J. Lakusiewicz, 1316 Euel Rd., Poplar Bluff, Mo. 63901

[ * ] Notice: This patent is subject to a terminal disclaimer.

[21] Appl. No.: 09/074,134

[22] Filed: May 7, 1998

[51] Int. Cl.[7] ..... A63B 37/00

[52] U.S. Cl. ..... 473/128; 425/2; 264/222; 264/DIG. 30

[58] Field of Search ..... 425/2; 264/222, 264/DIG. 30; 473/127, 128, 129, 130

[56] References Cited

U.S. PATENT DOCUMENTS

| | | | |
|---|---|---|---|
| 2,656,188 | 10/1953 | Anderson | 473/128 |
| 4,358,112 | 11/1982 | Straborny . | |
| 5,123,644 | 6/1992 | Bernhardt | 473/130 |
| 5,308,061 | 5/1994 | Bernhardt | 473/127 |
| 5,330,392 | 7/1994 | Bresin et al. | 473/130 |
| 5,391,117 | 2/1995 | Miller | 473/128 |
| 5,813,918 | 9/1998 | Conigliaro | 473/128 |

OTHER PUBLICATIONS

Dental Gypsum Products, "Dental Materials Science introductory lectures", http://www.umds.ac.uk/dms/gypsum.htm, Aug. 1999.

*Primary Examiner*—William M. Pierce

*Attorney, Agent, or Firm*—Blackwell Sanders Peper Martin

[57] ABSTRACT

A precise, anatomically configured finger insert for the holes of a bowling ball conforms to the exact size and shape of the bowler's fingers prior to the insert being set into the predrilled holes of the bowling ball. The inserts are formed from a soft, resilient elastomer that favors rather than resists the full spectrum of all finger shapes. The insert is vented to eliminate the vacuum effect produced when the fingers are very rapidly removed from a tightly confined space, the venting allowing for ease of finger extraction upon release of the bowling ball, the venting spaces in plurality also allowing the soft deformable elastomer to accommodate finger size change secondary to swelling by pushing into the venting spaces. The method of production of the finger hole inserts yields inserts that are unique and personal for each individual bowler, yet capable of being mass produced. Exact duplication of the insert is possible, making any anatomically configured insert from the same production feel exactly the same in any bowling ball regardless of how many bowling balls the bowler may use.

6 Claims, 3 Drawing Sheets

ANATOMICALLY CONFIGURED FINGER INSERTS FOR A BOWLING BALL

FIELD OF INVENTION

The Invention pertains to inserts that are placed in the pre-drilled holes of a bowling ball that allow the easy and comfortable placement of fingers into the bowling ball holes regardless of the size, shape, or deformity of the fingers.

A precise anatomically configured finger insert for the holes of a bowling ball that is made to conform to the exact size and shape of the bowler's fingers prior to the insert being set into the pre-drilled holes of the bowling ball. The invention is manufactured from a soft, resilient elastomer that favors rather than resists the full spectrum of all finger shapes. Importantly, the invention is vented to eliminate the vacuum effect produced when the fingers are very rapidly removed from a tightly confined space, the venting allowing for ease of finger extraction upon release of the bowling ball; the venting spaces in plurality also allowing the soft deformable elastomer to accommodate finger size change secondary to swelling by pushing into the venting spaces. The present invention also details a preferred method of production of the finger inserts of bowling balls that yields finger inserts that are totally unique and personal (i.e. "unique") for each individual bowler, yet can be mass produced. Exact duplication of the insert is possible, making any anatomically configured insert from the same production feel exactly the same in any bowling ball regardless of how many bowling balls the bowler may use.

BACKGROUND OF THE INVENTION

Equipment for the sport of bowling has made great advances. Bowling balls are now made of technically superior cores that by their design, can produce and alter the balls travel characteristics; the cores covered at the outer most surface of the ball by various materials such as hard rubber, plastic, polyurethanes, and other synthetics all designed to accommodate the ball to any lane conditions. Thus, a superior sports apparatus is presented to every bowler.

The task of mating the appropriate ball to a bowler is in the hands of the person who actually drills the holes in the ball that receive the bowler's fingers, by which the ball is firmly gripped. In spite of the fact that all the drilling is expertly done, in an apparatus that is exquisitely technically made, and in many instances by the same driller, every bowler from the level of the professional to the weekend social bowler will too often be heard to remark, "All my bowling balls feel different." The problem is that it is almost impossible to standardize a "feel" regardless of how good a driller and his/her equipment may be. Therefore, the real problem lies at the exact interface of the bowler's fingers and the drilled holes of the ball, for regardless of how technically well designed the ball, how many wrist splints, gloves and other accessories are employed, the bowler will not achieve the goal of bowling his/her personal best unless the ball when gripped and released has the consistent "right feel" and is pain-free regardless of which of his bowling balls the bowler uses. The key, then is standardization, the question is "how", when every bowler's fingers are different.

Without reciting a litany of all the inventors of prior art who tried to solve the problem of bowler-ball interface by using finger inserts placed into the drilled holes of the bowling ball and regardless of how the prior art inserts were technically designed and manufactured, they appear to have all had the same common characteristic in that they all tried to adapt a non-anatomically shaped insert to a constantly changing anatomical body part. Essentially, almost all prior art inserts are either round or oval in the actual contact chamber receiving the finger that is never always consistently round or oval, therefore, the only recourse was to grind down the part of the round or oval shape that produced pain and take on the impossible task of exactly reproducing the grind down shape "that works" for every single ball a particular bowler owns to achieve a "consistent feel".

The present invention offers a solution to the problem of mismatch of a non-anatomically shaped insert to a constantly changing anatomical body part, by not trying to stereotype the shape of the insert, but by embracing the constantly changing anatomical shape. Once the specific finger shape is precisely defined, it can then be incorporated within the cylindrical shape of the drill hole and inserted into the ball. With the original anatomical shape precisely defined and recorded, it can be duplicated ad infinatum and placed into every bowling ball a bowler has thus achieving the long sought after goal of standardizing the "right feel" uniquely and specifically for each and every bowler.

BRIEF SUMMARY OF THE INVENTION

The present invention is a finger insert adapted for use in the drilled holes of a bowling ball, precisely fitting the anatomical size and shape of the user's fingers, to ensure the proper "feel" of grip necessary for the bowler to hold, release, and use a bowling ball correctly and pain-free. The proper "feel" is consistently attained with every finger insert because the anatomical shape with all its variables unique to each person and each finger is literally captured and placed into each finger insert. Once this is done, that specific, unique anatomical shape can be easily replicated ad infinatum thus making the number of bowling balls into which the replicated inserts are placed essentially infinite with each bowling ball "feeling" the same during grip to the specific user whose anatomical shape is captured in the insert. The method of capture and manufacture attains a standardization for each bowler of each of his/her fingers that is unique only to that individual bowler regardless of what variable or deformity may exist relative to each finger. In essence, the bowler fixates the form of his/her exact self into every bowling ball used. The finger insert produced by the method of standardization of the present invention is comprised of, but not limited to, elastomers of soft polyurethane or silicone that have been fully "cured". The anatomically configured mold of the bowler's finger is contained in a cylindrical mold whose outer diameter matches the diameter of the drilled hole in the bowling ball. When the finger insert is fully seated in the drilled hole and anchored by the appropriate adhesive, the finger is admitted into an insert negative mold of its own precisely configured shape that is soft by nature of the resiliency of the elastomer. The vent opening in the distal end of the insert allows air to pass through the hollow insert mold containing the finger, and a plurality of cylindrical parallel spaces running within the wall of the elastomeric cylinder mold. This prevents any tendency to get "hung up" in the ball when releasing grip that might be secondary to vacuum suction. The effect of swelling of the fingers during use is dissipated by the flow of the soft elastomer in multiple directions, but particularly deforming into the plurality of spaces, thusly the spaces serve a dual function of transmission of air in two directions depending on entrance or removal of the finger from the insert negative mold, and to allow a relative area of expansion, which when the plurality of spaces is taken cumulatively, provides a mechanism to accommodate swelling of the finger, by temporarily collapsing their diameters.

The advantages of the invention over the prior art in addition to the aforegoing are:

1. Eliminates the conflict of attempting to conform an anatomical shape to a stereotypic form.
2. Provides a method to standardize variables of size, shape, and deformity.
3. Method of standardization embraces the deformities and variables of shape and actually uses them.
4. The soft resiliency of the elastomer decreases irritation to deformities and therefore reduces the propensity for the deformities to be aggravated and worsen.
5. The slight compressibility and the flow of the soft elastomer combined with bidirectional air exchange to the atmosphere allow for smooth, easy, pain-free extraction of the finger from the insert.
6. Can initiate the first finger insert, and produce unlimited exact duplications without actually physically seeing the finger.
7. Allows for the ultimate customization of any bowling ball by placing a true extension of the bowler's fingers into the ball.

DETAILED DESCRIPTION OF THE PREFERRED EMBODIMENT

Figure 2:
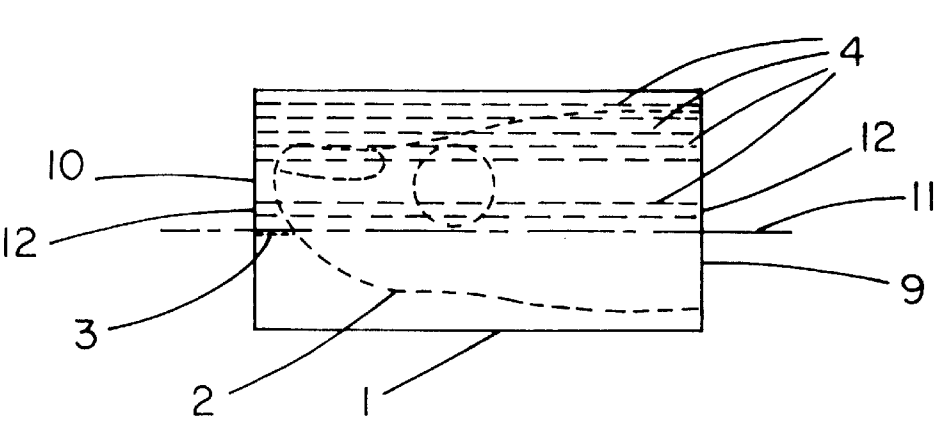
FIG. 2 is a side perspective view of the invention showing the hollow anatomically configured negative mold 2 of a thumb contained within a solid cylindrical mold 1, having a plurality of cylindrical, parallel spaces 4 disposed anterior (dorsal) to the mid-axial plane 11 of the cylindrical mold 1, and a vent opening 3 disposed distally in the cylindrical mold 1 located on the mid-axial plane 11 opening onto the external surface of the distal end 10 of the cylindrical mold 1 and into the distal end of the anatomically configured negative mold 2.

The present invention is described as the end product of a method that is extremely important in enabling the invention to be produced in mass production, complimenting the standardization produced by the method that occurs for each specific individual user.

The standardization method is comprised simply of placing a finger into a special molding substance that is safe against the skin such as but not limited to, a high purity silicone rubber such as Ply-o-Life which may be obtained commercially from companies such as Pink House Studios, Inc. The high purity silicone rubber presents in two parts in the procured state, a base and a catalyst. When mixed together in equal parts at room temperature and applied to the finger over any moisturizer such as hand lotion which facilitates removal of the Ply-o-Life, the Ply-o-Life will cure safely without harm to the user at room temperature. The pre-cured mixture of Ply-o-Life is a smooth paste in consistency, then transforms into a flexible solid consistency termed cured in approximately 7 minutes. The finger is then easily extracted from the Ply-o-Life mold which now represents an exact copy of the finger, termed the anatomically configured negative mold 2, 6, although not the end product invention, the anatomically configured negative mold 2, 6, comprised of Ply-o-Life, is now the standardized piece of the invention method that permits all subsequent finger inserts made from it to be precisely the same in size and shape. A slurry of dental stone modeling compound obtained from any commercial source such as the Memphis Dental Manufacturing Co. is then introduced into the Ply-o-Life anatomically configured negative mold 2, 6, and allowed to set-up at room temperature thus becoming rock hard, then being easily removed from the Ply-o-Life mold 2, 6. The rock hard dental stone model which is now the positive mold of the finger is placed centrally located, and coaxially aligned, into a rigid cylindrical containment mold whose inner diameter is equal to the drilled hole of the bowling ball. Within the containment mold is a solid, rectangular projection approximately ⅛" thick, attached to the inside bottom of the containment mold, oriented vertically, standing on its lesser dimension end of approximately ⅜" and having a vertical height of approximately ¾". The rectangular projection is centrally located at the bottom of the containment mold and its vertical extent allows it to enter a prepared slot in the distal end of the dental stone model, for approximately ¼". Also attached to the bottom of the containment mold is a plurality of solid cylindrical rods each of ⅛" diameter, oriented vertically standing on end with their long axis parallel to the long axis of the containment mold, all rods disposed to one side of the mid-axial plane of the containment mold, and further disposed equidistant between the inner aspect of the wall of the containment mold and the external surface of the dental stone model of the finger. The attachments of the rectangular projection and the plurality of cylindrical rods to the bottom of the containment mold allow extraction of the rods and the rectangular projection through the bottom of the containment mold which is closed; the opposite top end of the containment mold is fully open.

The end product invention is obtained by pouring an equal part mixture of base and catalyst of elastomers such as but not limited to, external prosthetic quality silicone obtained commercially from Factor 2 Co. or room temperature vulcanizing RTV liquid rubber polyurethane, poly 74 series, commercially obtained from Polytek Development Co. into the containment mold to totally bathe the entire contents of the dental stone model, rods, rectangular projection, and total inner aspect of the containment mold.

Prior to pouring the mixture of elastomer into the containment mold, the containment mold being comprised of either polyethylene, or a metal such as but not limited to, hard coat anodized aluminum, or stainless steel, the dental stone model, rods, rectangular projection and entire inner aspect of the containment mold are coated with a separator, such as but not limited to, zinc stearate or petroleum soap compound.

Figure 3:
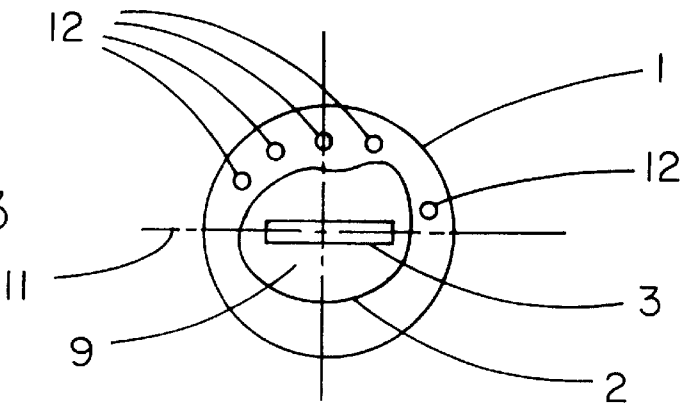
FIG. 3 is a proximal end perspective view of the invention showing the entrance opening 9 of the anatomically configured negative mold 2 of a thumb centrally located within the cylindrical mold 1, the openings 12 of the cylindrical parallel spaces 4, and the vent opening 3 communicating the hollow interior of the anatomically configured negative mold 2 with the external surface of the distal end 10 of the cylindrical mold 1.
Figure 1:
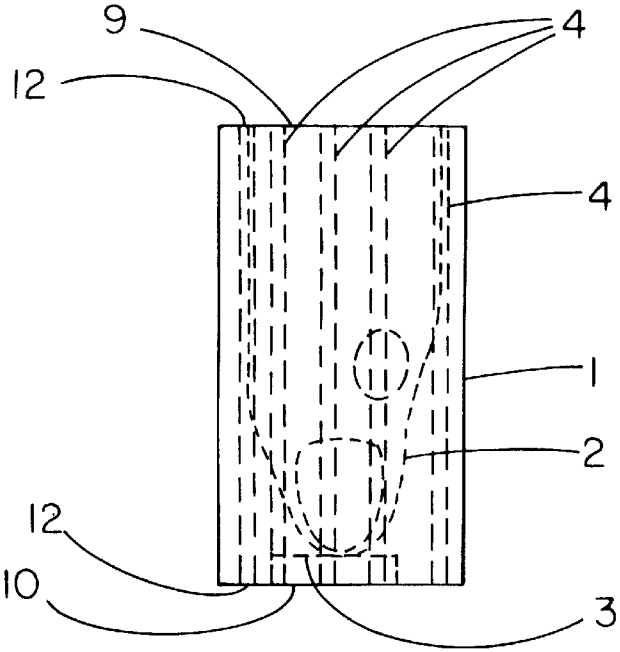
FIG. 1 is a front perspective view of the invention showing the hollow anatomically configured negative mold 2 of a thumb contained within a solid cylindrical mold 1, having a plurality of cylindrical parallel spaces 4 not opening into the anatomically configured negative mold 2, but each having an opening 12 at each end of the cylindrical mold 1; and a vent opening 3 disposed distally in the cylindrical mold 1 that opens into the anatomically configured negative mold 2 and to the external surface of the distal end 10 of the cylindrical mold 1.
Figure 5:
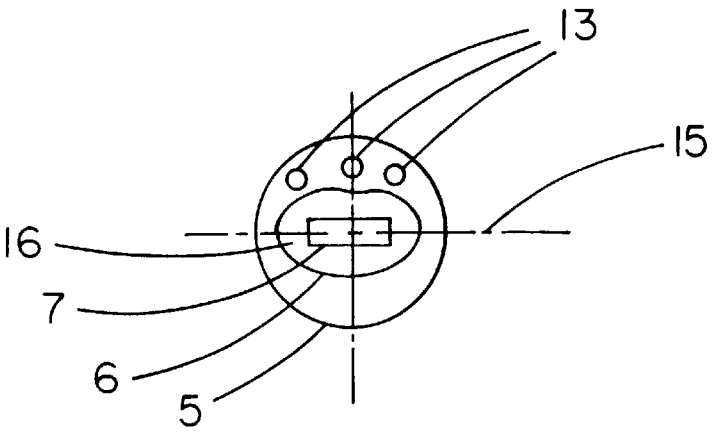
FIG. 5 is a proximal end perspective view of the invention showing the entrance opening 16 of the anatomically configured mold 6 of a finger centrally located within the cylindrical mold 5; the openings 13 of the cylindrical parallel spaces 8; and vent opening 7 communicating the hollow interior of the anatomically configured negative mold 6 with the external surface of the distal end 14 of the cylindrical mold 5.
Figure 6:
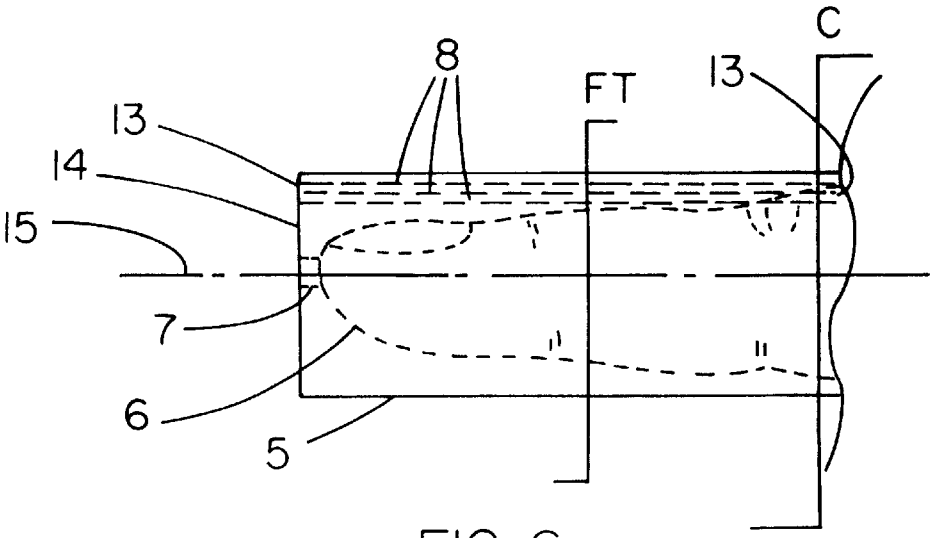
FIG. 6 is a side perspective view of the invention showing the hollow anatomically configured negative mold 6 of a finger contained within a solid cylindrical mold 5 having a plurality of cylindrical, parallel spaces 8 disposed anterior (dorsal) to the mid-axial plane 15 of the cylindrical mold 5, and a vent opening 7 disposed distally in the cylindrical mold 5 located on the mid-axial plane 15 opening onto the external surface of the distal end 14 of the cylindrical mold 5 and into the distal end of the anatomically configured negative mold 6. The portion of the invention delineated between the external surface of the distal end 14 of the cylindrical mold 5 and the plane FT represents the configuration of a finger tip grip insert; the portion of the invention delineated between the external surface of the distal end 14 of the cylindrical mold 5 and the Plane C represents the configuration of a conventional grip insert.
Figure 4:
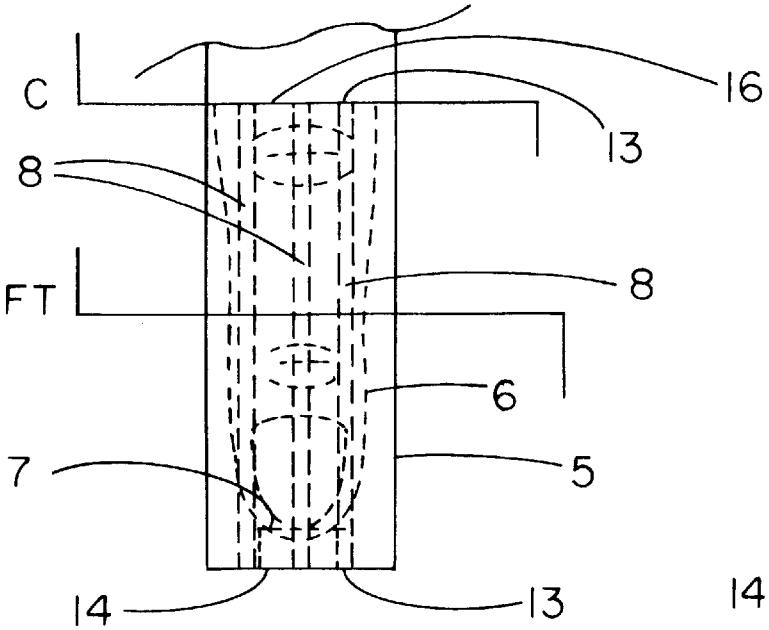
FIG. 4 is a front perspective view of the invention showing the hollow anatomically configured negative mold 6 of a finger contained within a solid cylindrical mold 5 having a plurality of cylindrical parallel spaces 8 not opening into the anatomically configured negative mold 6, but each having an opening 13 at each end of the cylindrical mold 5 and a vent opening 7 disposed distally in the cylindrical mold 5 that opens into the anatomically configured negative mold 6 and onto the external s surface of the distal end 14 of the cylindrical mold 5. The portion of the invention delineated between the external surface of the distal end 14 of the cylindrical mold 5 and the plane FT represents the configuration of a finger tip grip insert; the portion of the invention delineated between the external surface of the distal end 14 of the cylindrical mold 5 and the plane C represents the configuration of a conventional grip insert.
Figure 7:
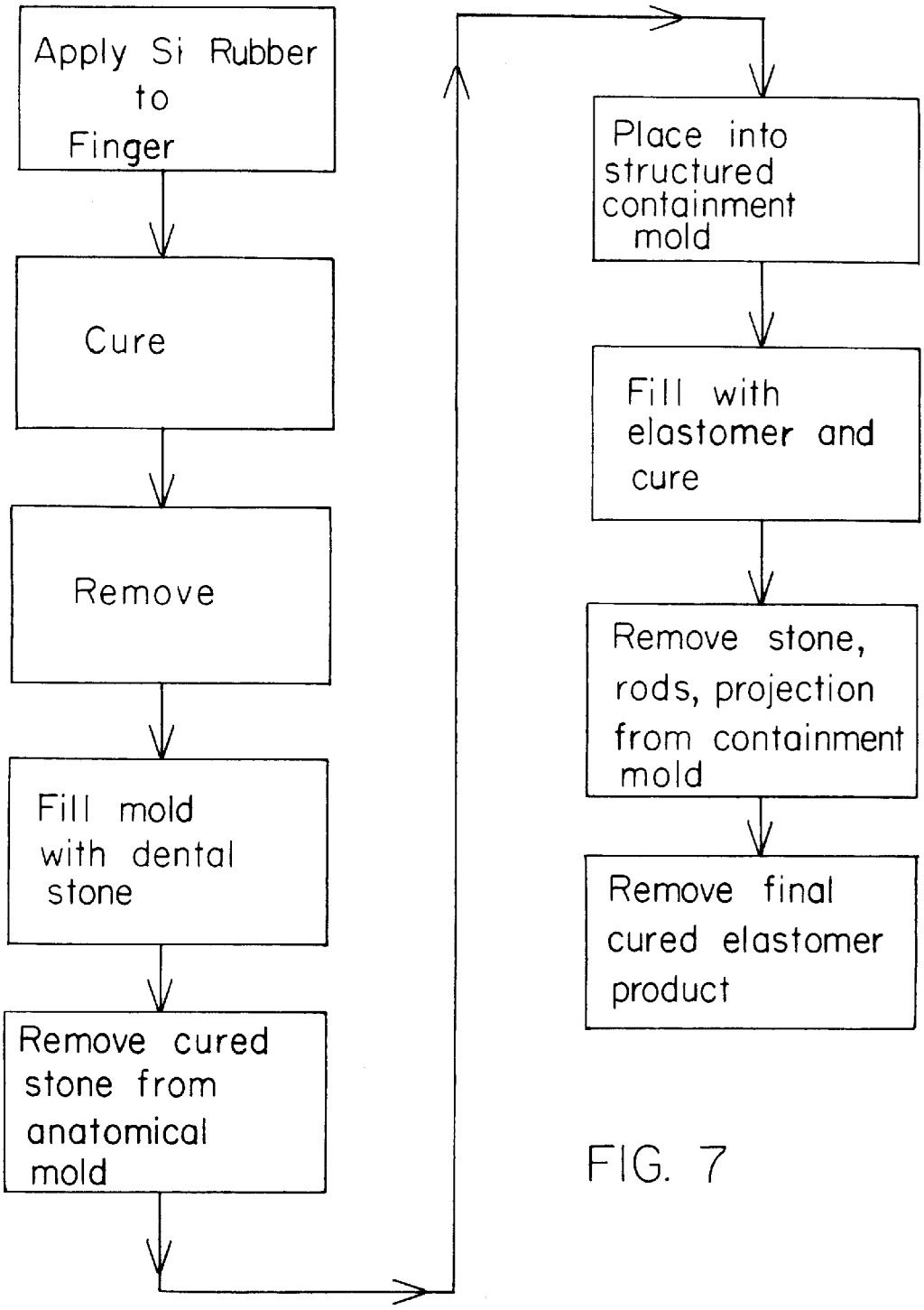
FIG. 7 is a schematic illustration of the method of forming a finger insert of the present invention.

The elastomer is cured either at room temperature, or slightly elevated temperature up to 140 degrees F (60 degrees C) in a conventional heat oven to accelerate the curing speed. After the elastomer is fully cured as determined by its solid consistency, it is then removed from the containment mold as one en bloc (unitary) solid piece represented in FIG. 1, FIG. 2, and FIG. 3 as 1; and in FIG. 4, FIG. 5, and FIG. 6 as 5. Removal of the dental stone model from the elastomer creates the anatomically configured negative mold 2, 6; removal of the rectangular projection from the elastomer creates the vent opening 3, 7; and removal of the cylindrical rods from the elastomer creates the plurality of parallel, cylindrical spaces 4, 8.

The invention is then ready to be placed into the appropriate drilled hole of the bowling ball and secured in position by a gel formulation of cyanoacrylate for the polyurethane elastomer; silastic adhesive for the silicone elastomer; and whatever other adhesive is deemed appropriate for any other elastomer which may be chosen.

Once the Ply-o-Life mold is made, the method previously stated may be repeated an unlimited number of times, literally placing an extension of the bowler's own fingers in every bowling ball that is owned by the bowler thus standardizing the individual bowler's personal and unique "feeling" of equipment that has previously been such a strongly desired, but elusive goal.

What is claimed:

1. A soft, deformable insert for a bowling ball, sized to fit within a drilled finger hole of the ball and anatomically configured in exact size and shape to receive a bowler's finger placed within the insert, the insert comprising:

a cylinder formed of a soft, deformable, resilient elastomer and having an outer surface disposed to contact and be affixed to an inner surface of a finger hole of a bowling ball;

the cylinder having an inner surface defining a hollow space configured to an unique anatomical shape of a finger disposed within and coaxial with, the cylinder, with a central opening in one end to receive a bowler's finger, and a central opening in an opposite end communicating with an outer surface of the end of the cylinder;

the cylinder further defining a plurality of cylindrical spaces disposed within the cylinder, parallel with the long axis of the cylinder, all cylindrical spaces being disposed to one side of a mid-axial plane of the cylinder and opening to the outer surface of both ends of the cylinder, the plurality of cylindrical spaces serving to transmit air to the atmosphere and to accept an increase in volume of the inner hollow space when the inner hollow space is deformed by an increase in girth of the bowler's finger, to thereby automatically accommodate natural changes in finger girth which occur during bowling without requiring the bowler to change bowling balls or inserts.

2. The soft deformable insert of claim 1, wherein the central opening of the inner hollow space has an unique anatomically configured region devoid of cylindrical spaces disposed to one side of the mid-axial plane, and positioned to interact with a ventral surface of the bowler's finger when the finger is placed into the insert.

3. The soft deformable insert of claim 1, wherein the insert is formed of an elastomer such as soft, resilient polyurethane, and soft external prosthetic quality silicone.

4. A method of producing a precisely anatomically configured finger insert for the drilled hole of a bowling ball which allows unlimited replication of all the finger inserts of any individual bowler to be standardized, thusly, standardizing the "feeling" with which a bowling ball is gripped, the method comprising the steps of:

applying a high purity silicone rubber in its totally mixed, pre-cured state to a finger;

allowing the high purity silicone rubber to fully cure while on the finger;

removing the cured high purity silicone rubber en bloc from the finger, thus providing a precise anatomically configured negative mold of the finger;

filling the anatomically configured negative mold with a slurry of dental stone and permitting it to cure therein;

removing the hard, cured dental stone from the precisely anatomically configured negative mold;

placing the cured dental stone into a structured containment mold, the structure within the containment mold including a plurality of cylindrical rods;

filling the containment mold with an elastomer, and allowing the elastomer to cure either at room temperature or at a slightly elevated temperature up to 140 degrees F in a conventional oven;

after the elastomer is fully cured, removing the dental stone and the plurality of cylindrical rods from the structured containment mold and the elastomer; and removing the cured elastomer from the containment mold, the elastomer forming a customized and exact anatomically configured finger insert.

5. The soft, deformable insert of claim 1, wherein the plurality of cylindrical spaces are disposed equidistant between an external aspect of the inner hollow space and the outer surface of the cylinder.

6. The soft, deformable insert of claim 1, wherein the plurality of cylindrical spaces are disposed at variable distances between each adjacent cylinder.

* * * * *